United States Patent [19]

Hannel

[11] Patent Number: 4,824,087

[45] Date of Patent: Apr. 25, 1989

[54] CLAMP

[75] Inventor: Clifford L. Hannel, Orange, Calif.

[73] Assignee: Lockheed Corporation, Calabasas, Calif.

[21] Appl. No.: 197,721

[22] Filed: May 23, 1988

[51] Int. Cl.[4] ..... B25B 1/08

[52] U.S. Cl. ..... 269/234; 74/110

[58] Field of Search ..... 269/234, 217, 221, 228, 269/224; 74/110

[56] References Cited

U.S. PATENT DOCUMENTS

| | | | |
|---|---|---|---|
| 2,625,861 | 1/1953 | Swanson | 269/234 |
| 2,841,196 | 7/1958 | Zazdrzyk . | |
| 3,170,322 | 2/1965 | Cavanaugh | 269/234 |
| 3,734,481 | 5/1973 | Surwill | 269/234 |
| 3,766,835 | 10/1973 | Kobelt | 74/110 |
| 3,802,688 | 4/1974 | Rolke et al. | 269/234 |
| 3,857,496 | 12/1974 | Gonzales | 74/110 |
| 4,225,110 | 9/1980 | Akkerman et al. | 74/110 |

*Primary Examiner*—Robert C. Watson

*Attorney, Agent, or Firm*—Louis L. Dachs

[57] ABSTRACT

The invention is a clamp. In detail, the clamp comprises a base having a vertical disposed first jaw rising from the base. A second jaw is movably mounted to the base, the second jaw being movable in a horizontal direction to and from the first jaw. An actuation system is mounted to the base and is coupled to the second jaw such that upon the application of a vertically directed actuation force the second jaw can be either moved toward or away from the first jaw.

3 Claims, 3 Drawing Sheets

CLAMP

TECHNICAL FIELD

The invention relates to the field of clamps and, in particular, to a clamp that has the jaws activated to the open and closed position in one plane and is adapted to be activated by force applied perpendicular thereto.

BACKGROUND INFORMATION

There are hundreds of types of clamps used to position parts during manufacturing operations that use hand operated overcenter latches. One such example is found in U.S. patent application No. 2,841,196 "Toggle Lever Actuated Sliding Jaw Vise" by E. Zazdrzyk. However, with the advent of automated assembly machines the use of tooling clamps designed to be hand operated presents problems. While machines can be programmed to accomplished the more complicated two-dimensional rotation and translations required for hand operated clamps, it is much easier to program for a single up or down motion. In the FAAST subassembly parts for flat panel "next" assemblies such as aircraft ribs are transferred to the FAAST on a tray and visually inspected by a computer controlled system. Thereafter the next assembly is identified and reconfigurable tooling is assembled by means of overhead robot manipulators which position support beams on which subassembly clamps are thereafter positioned and held in place by magnetic chucks. The robot manipulators then position the subassembly parts on the assembled tooling and clamps them into place. The subassembly parts are then fastened together. These latter steps are also accomplished by the robot manipulators. The clamps must be positioned in precise locations at different angles and spacing, etc. Thus, it is desirable to have a clamp which can be activated in a single up and down motion of the robot manipulator and preferably motion in only one direction.

Furthermore, it is advantageous to be able to horizontally clamp a part in place while applying the actuation force in a vertical direction in order to isolate the actuation force from the "clamping force", thus avoiding part movement during clamping.

Thus, it is a primary object of the subject invention to provide a clamp for locking parts in place which can be actuated to the locked and unlocked position by applying an actuation force in only one direction.

It is another primary object of the subject invention to provide a clamp for locking parts in place wherein the clamping force is applied in a direction perpendicular to the direction to which the resultant actuation force is applied.

It is a further object of the subject invention to provide a clamp for locking parts in place wherein the actuation force need not be accurately applied.

DISCLOSURE OF THE INVENTION

The invention is a clamp for use in holding a plurality of parts in position during the joining together thereof. It is primarily adapted for use in automated computer control assembly equipment such as the previously mentioned FAAST.

The clamp comprises a base having a vertically disposed first jaw rising from the base. A second jaw is movably mounted in the base and movable in a horizontal direction to and from the first jaw. Actuation means are incorporated into the base which couple to the second jaw which is adapted to receive an actuation force applied from a vertical direction to move the second jaw in a horizontal direction clamping the part in place.

In detail, the actuation means comprises the base including first and second vertical bores and a horizontal bore in communication with the second vertical bore. First and second rods are movably mounted in the first and second bores, respectively. However, the first and second rods have first ends extending out of the bores above the top of the base. Furthermore, the second end of the second rod includes a cam surface thereon.

A first rocker link is rotatably mounted at one end to the first rod and at its opposite end to the second rod and rotatably mounted therebetween to the base. As the second rod is pushed downward the first rod is driven upward and as the first rod is pushed downward the second rod is driven upward. A third rod is movably mounted in the horizontal bore and includes a cam follower at one end in contact with the cam surface at the end of the second rod. Biasing means in the form of a spring is in contact with the third rod and bias the third rod toward the second rod such that the cam follower is in contact with the cam surface. A second rocker link is rotatably mounted at its first end to the second jaw and rotatably mounted at its second end to the third rod and rotatably mounted therebetween to the base.

Thus, as the second rod is moved downward the cam surface engaging the cam follower drives the third rod away from the first jaw and drives the second jaw towards the first jaw by rotation of the second rocker link and the first rod is driven upward upon rotation of the first rocker link. Pushing the first rod downward reverses the motion causing the second jaw to move away from the first jaw, because the spring urges the third rod toward the first jaw. In the preferred embodiment the clamp includes a magnetic chuck for mounting the clamp to a surface such as a support beam in the FAAST system.

The novel features which are believed to be characteristic of the invention, both as to its organization and method of operation, together with further objects and advantages thereof, will be better understood from the following description in connection with the accompanying drawings in which the presently preferred embodiment of the invention is illustrated by way of example. It is to be expressly understood, however, that the drawings are for purposes of illustration and description only and are not intended as a definition of the limits of the invention.

BRIEF DESCRIPTION OF THE DRAWINGS

Illustrated in FIG. 1 is a front elevation view of the clamp.

Illustrated in FIG. 2 is a side view of the clamp.

Figure 3:
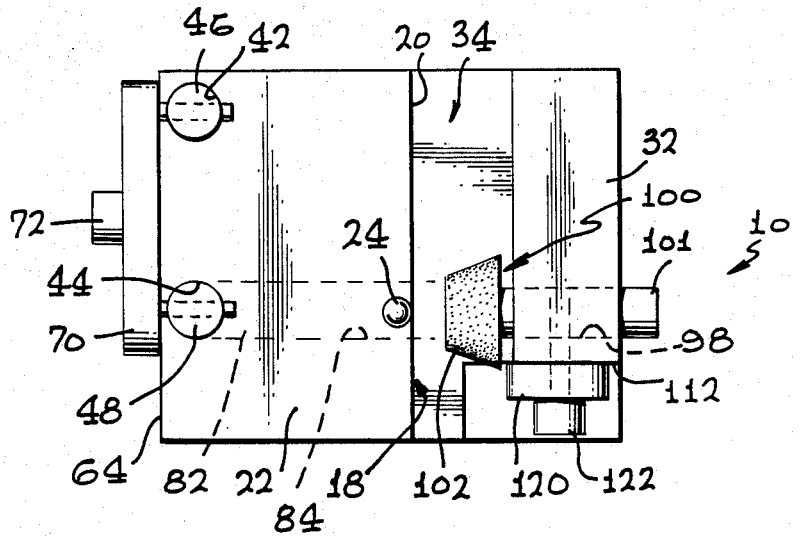

Illustrated in FIG. 3 is a top view of the clamp.

Figure 2:
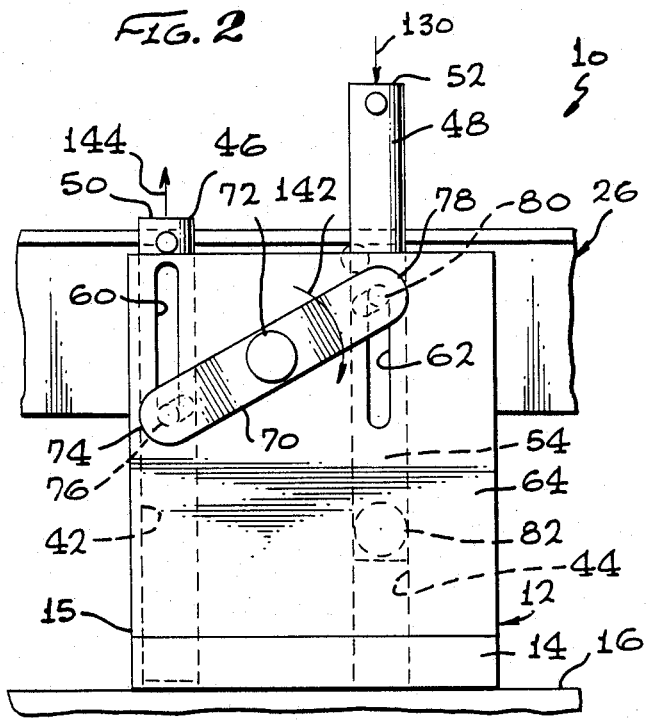
Figure 4:
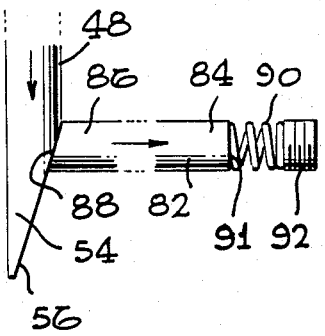

Illustrated in FIG. 4 is a partial view of the clamp shown in FIG. 2.

Figure 5:
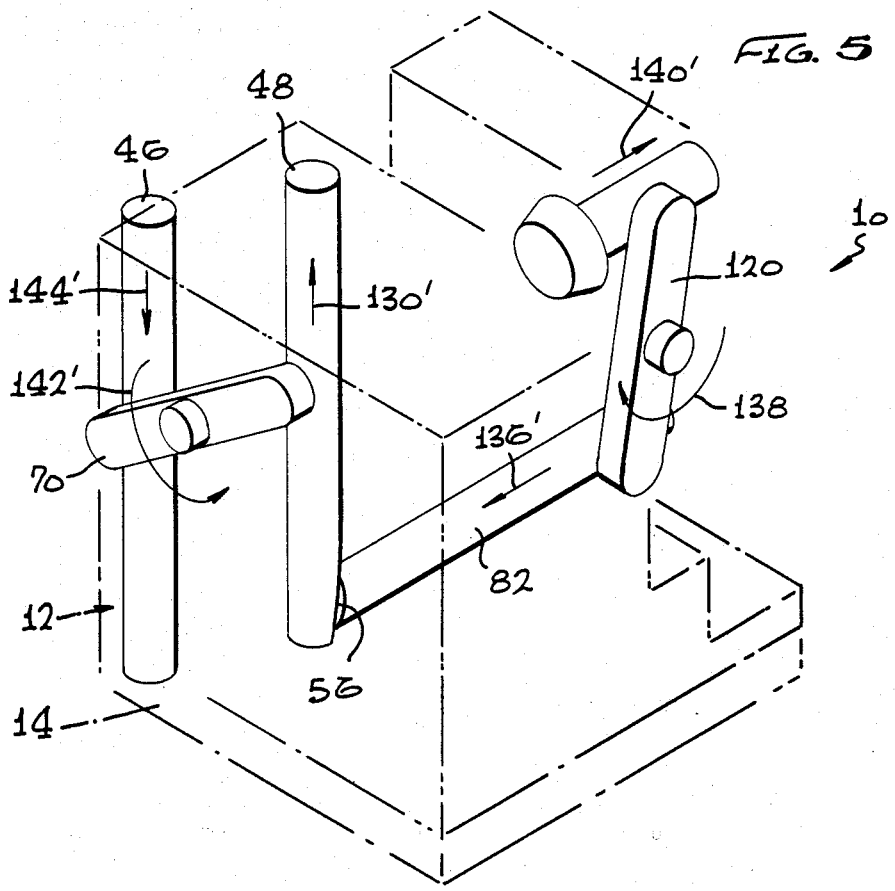

Illustrated in FIG. 5 is a partial schematic perspective view of the actuation system of the clamp for locking and unlocking parts in place, wherein the clamp is shown in the unlocking mode.

Figure 6:
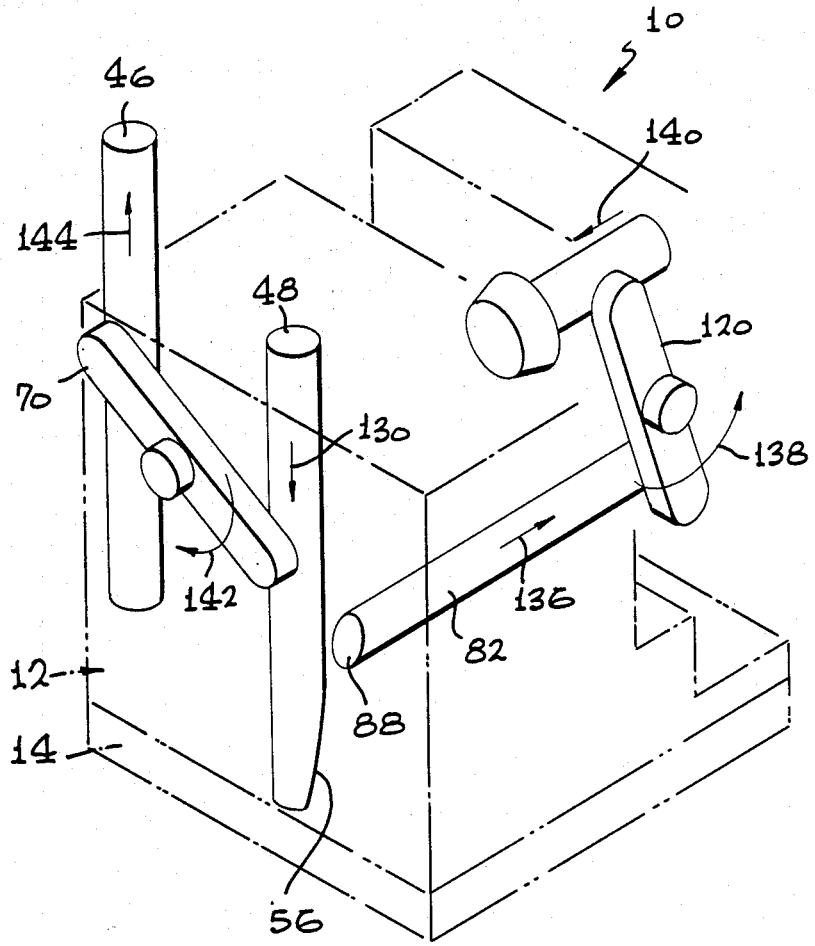

Illustrated in FIG. 6 is a second partial schematic perspective view of the actuation system wherein the clamp is in the unlocking mode.

BEST MODE FOR CARRYING OUT THE INVENTION

Referring to the FIGS. 1–4 it can be seen that the clamp, generally designated by numeral 10, comprises a base member 12 having a magnetic chuck 14 mounted to its bottom portion 15. The magnetic chuck 14 is used to secure the clamp to a tooling beam 16 (not part of the invention). The base member 12 includes a vertically depressed first jaw 18 having a jaw face 20 and a top surface 22 with a tooling button 24 thereon. The button 24 provides a precise point for locating parts. Shown mounted in the clamp is a bracket 26 that is typical of the parts that must be accommodated. As illustrated the bracket 26 comprises a leg portion 28 butted against the jaw face 20 and a flange portion 30 in contact with the tooling button 24. Thus, it can be seen that in any typical assembling operation a plurality of clamps 10 would be required to position such a part as bracket 26, for subsequent joining to other subassembly parts. However, for purposes of description only one clamp is shown. The base member 12 also includes a vertically disposed support 32 forming a channel 34 between it and the first jaw 18.

The base member 12 further includes first and second vertical bores 42 and 44 wherein first and second rods 46 and 48 are, respectively, slideably mounted therein. The first and second rods 46 and 48 have flat ends 50 and 52, respectively, which extend out of the vertical bores 42 and 44 a substantial distance above the surface 22 of the base member 12. The flat ends of the rods provide a large surface over which the actuation force can be applied. Additionally, the second end 54 of the second rod 48 includes a cam surface 56 (best seen in FIG. 4). A pair of vertical slots 60 and 62 extend from the back surface 64 of the base member 12 into communication with the first and second bores 42 and 44, respectively. A first rocker link 70 is rotatably mounted at its center to surface 64 via pin 72. It is rotatably mounted at its first end 74 to first rod 46 via pin 76 which extends through slot 60 and by its second end 78 to second rod 48 via pin 80 which extends through slot 62. Thus, it can be seen that if rod 48 is pushed downward, rod 46 will be pushed upward and vice versa.

A third rod 82 is slideably mounted in horizontal bore 84 in the base member 12. The rod 82 includes a first end 86 terminating in a cam follower 88 (best seen in FIG. 5). The cam follower 88 of rod 82 is biased towards the cam surface 56 of the second rod 48 by means of a spring 90 mounted in the bore 84 in contact with end 91 of rod 82 and held in place by adjustable threaded plug 92.

The support 32 has a through bore 98. A second jaw 100 includes a shaft 101 which slideably mounts in the bore 98 and further includes an adjustable rubber-tipped head 102 mounted thereto which extends into the channel 34. The member also incorporates an elongated horizontal slot 110 which extends from surface 112 of the support 32 into bore 98. A second horizontal slot 114 is provided which extends from surface 112 to bore 84. A second rocker link 120 is rotatably mounted at its center to the support 32 via pin 122, rotatably mounted at its first end 123 to the shaft 101 via pin 124 which extends through horizontal slot 110 and by its second end 125 to rod 82 via pin 126 extending through horizontal slot 114.

Figure 1:
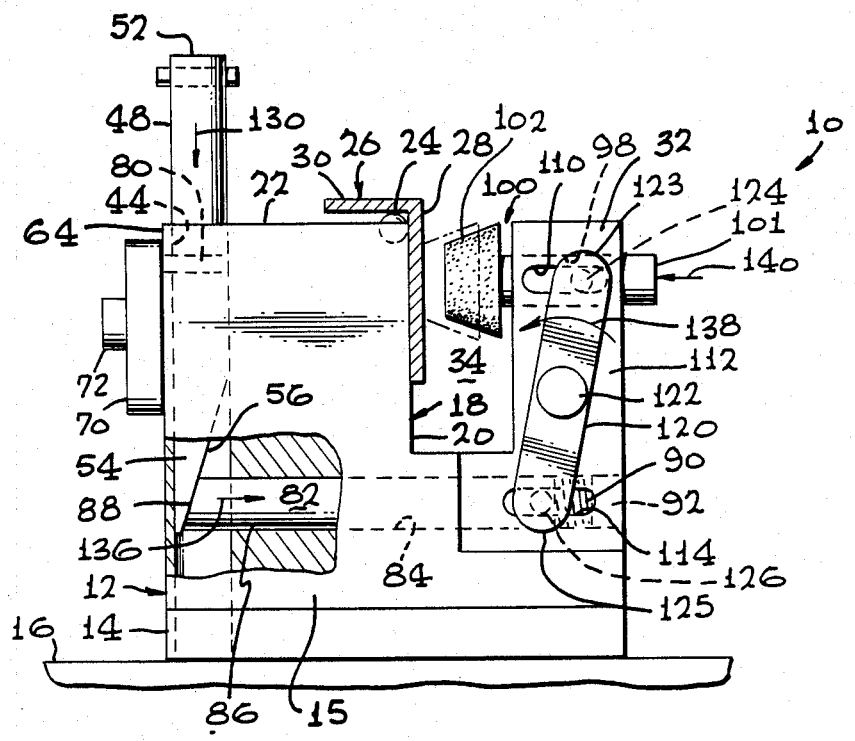

Still referring to FIGS. 1–4 and to FIG. 6, it can be seen that when the bracket 26 is positioned as illustrated in FIG. 1, pushing rod 48 at its end 52 will cause rod 48 to move downward which in turn causes the cam surface 56 in contact with cam follower 88 to move rod 82 further against spring 90 in the direction indicated by arrow 136. This in turn causes rocker link 120 to rotate counterclockwise, indicated by arrow 138, driving the second jaw 100 into engagement with leg 28 of the bracket 26, indicated by arrow 140, locking the bracket 26 to the first jaw 18 (as illustrated in dotted lines in FIG. 1). Simultaneously, rocker link 70 is rotated clockwise, indicated by arrow 142, causing rod 46 to vertically rise, indicated by arrow 144. Still referring now to FIGS. 1–4 and now FIG. 5 it can be seen that when the bracket 26 is to be released, pushing down on end 50 of rod 46 in the direction indicated by arrow 144' causes first rocker link 70 to rotate counterclockwise, indicated by arrow 142'. This in turn causes second rod 48 to rise in the direction indicated by arrow 130' and allows the rod 82 to translate horizontally in the direction indicated by arrow 136', urged by spring 90. Link 120 rotates clockwise, indicated by arrow 138' withdrawing the second jaw 100 from the bracket 26 in the direction indicated by arrow 140'.

Thus, the advantages of the clamp are readily apparent:

(1) a simple downward directed force can cause the clamp to lock or unlock;

(2) because the pins (46 and 48) have substantial contact surfaces at their flat ends (50 and 52) the force need not be pinpointed;

(3) the clamp can be used quite easily in the previously mentioned FAAST system and other automated assembly systems;

(4) The clamp is self adjusting.

While the invention has been described with reference to particular embodiment, it should be understood that the embodiment is merely illustrative as there are numerous variations and modifications which may be made by those skilled in the art. Thus, the invention is to be construed as being limited only by the spirit and scope of the appended claims.

Industrial Applicability

The invention has applicability in the manufacture of parts wherein components thereof must be clamped in place during joining operations.

I claim:

1. A clamp for locking a part comprising:

a base having a fixed vertically deposed first jaw rising from said base;

a second jaw movably mounted to said base, said second jaw moveable in a horizontal direction to a first position, locking the part to said first jaw, to a second position unlocking the part from said first jaw; and actuation means mounted to said base and coupled to said second jaw for receiving actuation forces applied from only one vertical direction to move said second jaw in said horizontal directions and for locking said second jaw in either said first or second position.

2. The clamp as set forth in claim 1, wherein said actuation means comprises:

said base having first and second vertical bores and a horizontal bore in communication with said second vertical bore;

first and second rods movably mounted in said first and second bores, respectively, said first and second rods having first ends extending out of said base, said second end of second rod having a cam surface thereon;

a first rocker link rotatably mounted at one end to said first rod and at the opposite end to said second rod and rotatably mounted therebetween to said base, such that as said second rod is pushed downward said first rod is driven upward and as said first rod is pushed downward said second rod is driven upward;

a third rod movably mounted in said horizontal bore having a cam follower in contact with said cam surface of said second end of said second rod;

biasing means in contact with said third rod for urging said cam follower of said third rod into contact with said cam surface of said second rod;

a second rocker link rotatably mounted at its first end to said second jaw and rotatably mounted at its second end to said third rod and rotatably mounted therebetween to said base; and such that as said second rod is moved downward, said cam surface engaged with said cam follower drives said third rod away from said second rod and driving said second jaw to said first position by rotation of said second rocker link and said first rod is driven upward upon rotation of said first rocker link and said second jaw is driven to said second position upon said first rod being driven downward.

3. The clamp as set forth in claim 2, wherein said base further includes a magnetic chuck for mounting the clamp.

* * * * *